United States Patent [19]

Grantom

[11] Patent Number: 4,898,238

[45] Date of Patent: Feb. 6, 1990

[54] PIPE SUPPORTING DEVICE

[76] Inventor: Charles A. Grantom, 2712 Frank Rd., Houston, Tex. 77032

[21] Appl. No.: 201,488

[22] Filed: Jun. 1, 1988

[51] Int. Cl.[4] ..... E21B 19/10

[52] U.S. Cl. ..... 166/75.1; 175/423; 188/67; 269/179; 269/181; 269/208; 269/902

[58] Field of Search ..... 175/423; 166/75.1, 85, 166/82, 84, 96, 76, 384, 385; 269/179, 902, 208, 287, 180, 181; 248/74.1, 316.4, 316.1, 56, 58; 188/67

[56] References Cited

U.S. PATENT DOCUMENTS

| | | | |
|---|---|---|---|
| 716,217 | 12/1902 | Glenn | 269/274 X |
| 870,419 | 11/1907 | Cyr | 269/208 X |
| 1,004,743 | 10/1911 | Cobb | 269/208 X |
| 1,048,705 | 12/1912 | Kleffman | 188/67 |
| 1,058,577 | 4/1913 | Gardner | 188/67 |
| 1,632,538 | 6/1927 | Brogden | 269/181 X |
| 1,837,990 | 12/1931 | Otis | 188/67 |
| 2,766,649 | 10/1956 | Labry, Jr. | 269/274 X |
| 2,906,151 | 9/1959 | Van Der Water | 269/208 X |
| 3,690,381 | 12/1972 | Slator et al. | 166/384 |

*Primary Examiner*—Hoang C. Dang

*Attorney, Agent, or Firm*—Pravel, Gambrell, Hewitt, Kimball & Krieger

[57] ABSTRACT

A device for the support of elongate members, such as tubing in a well bore, by a stationary gripping jaw and a movable gripping jaw. The movable gripping jaw is moved by a threaded shaft which pivots about one end into and out of engagement with a partially threaded nut to facilitate rapid movement of the movable gripping jaw relative to the stationary gripping jaw while maintaining the movable gripping jaw substantially vertical at all times. The stationary gripping jaw may be selectively positioned to accommodate a range of selected tubing sizes.

2 Claims, 3 Drawing Sheets

PIPE SUPPORTING DEVICE

FIELD OF THE INVENTION

The field of the invention includes devices for supporting pipes, rods, or other elongate members in a vertical position. Typically such elongate members are used in supporting tubing in a well bore.

DESCRIPTION OF THE PRIOR ART

Various devices for supporting tubing and the like have been used and known for many years. Examples of such prior art are found in U.S. Pat. Nos. 326,380; 416,903; 595,309; and 769,905. Devices having means for relocating one or more of the gripping jaws to accommodate different sizes of pipe or rod are also in the prior art. See, for example, U.S. Pat. Nos. 906,505; 1,041,762; and 2,854,216.

A relatively complicated means for providing quick adjustment of the gripping member is disclosed in U.S. Pat. No. 3,492,886.

It is an objective of this invention to provide a single device which is adjustable to a selected range of different pipe diameters, and which also has a relatively simple and efficient quick-acting means for the adjustment of the locking jaw, to thereby achieve durability and low repair costs.

SUMMARY OF THE INVENTION

The invention provides a device which has a stationary jaw capable of gripping pipe of a selected range of different diameters by virtue of its substantially V-shaped internal contour and by virtue of being relocatable with respect to a movable gripping jaw. The movable gripping jaw moves only in a linear mode and is positioned and tightened into place by use of a threaded shaft which pivots to disengage it from matching threads in a half-nut, while maintaining the movable gripping jaw in a substantially vertical position so as to provide at least four point contact areas on the pipe by two gripping faces on the stationary gripping jaw and the gripping face on the movable jaw, regardless of the relative positions of the jaws to each other.

DESCRIPTION OF THE PREFERRED EMBODIMENT

Figure 1:
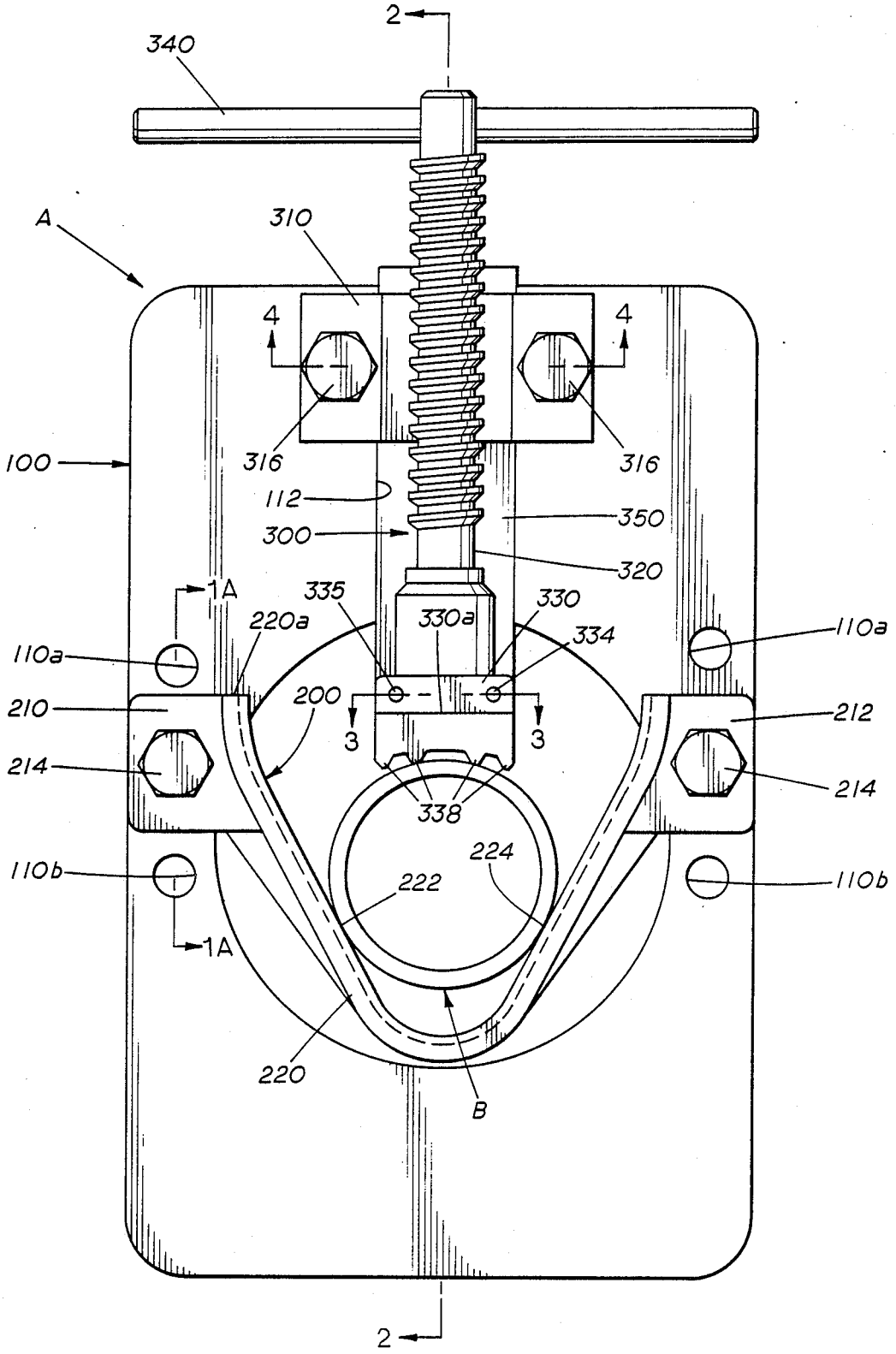
FIG. 1 is a plan view of the preferred embodiment of the invention.

The figures in the drawings will now be referred to in giving a detailed description of the preferred embodiment.

Referring now to FIG. 1, the device of the invention is generally indicated as A. The elongate member being gripped, such as a pipe, is indicated as B. Base plate 100 is firmly supported by and attached to a well platform not shown. Mounted on base plate 100 is stationary jaw

Figure 2:
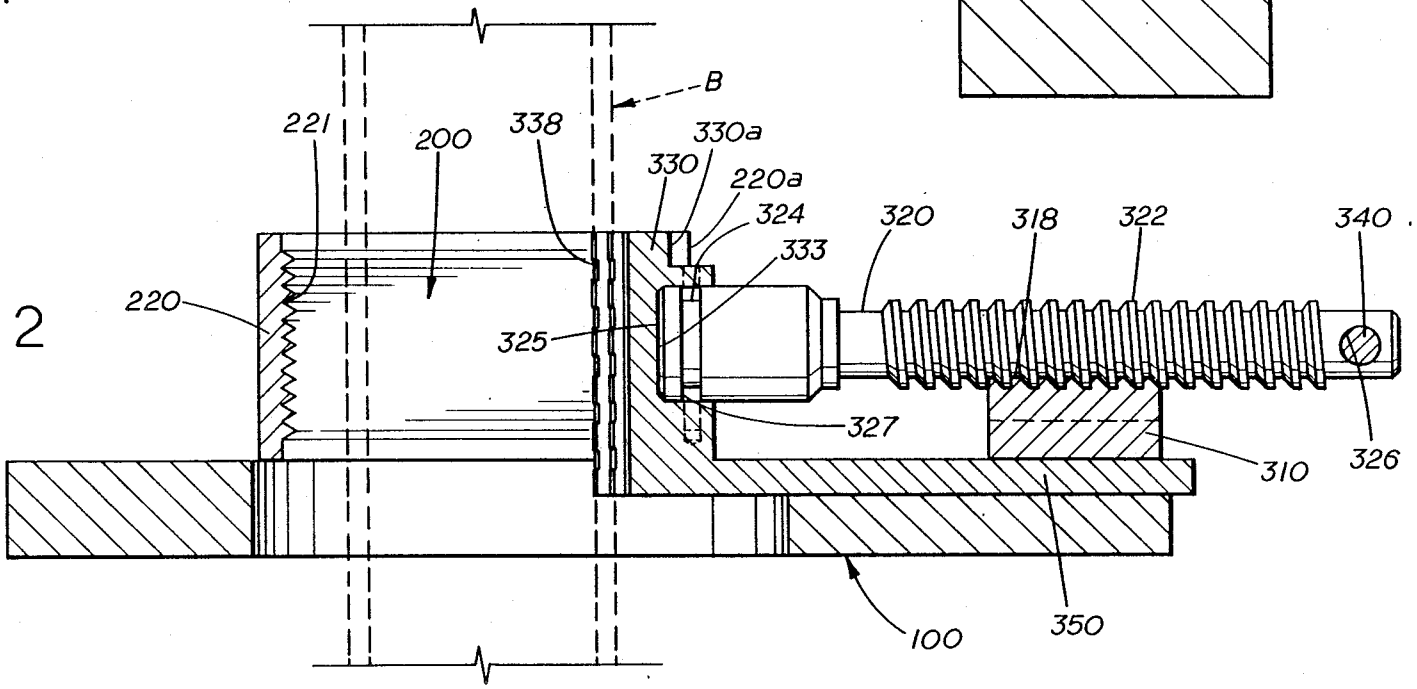
FIG. 2 is a sectional view of the preferred embodiment of the invention.
Figure 1A:
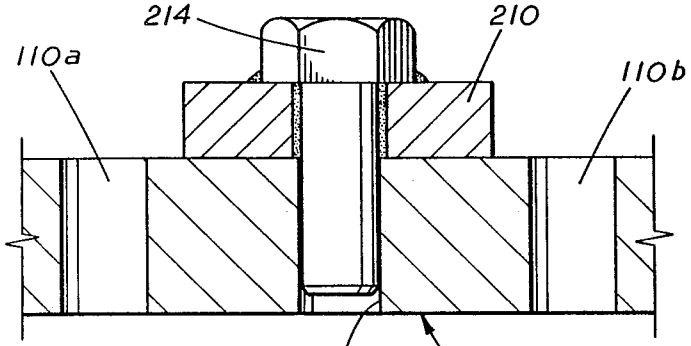
FIG. 1A is a partial section view taken on line 1A-1A of FIG. 1.

200. Pins 214 which are permanently attached to jaw 200 by welding or otherwise extend downwardly from the lower surface of jaw 200. Pins 214 are removably inserted in a pair of oppositely disposed holes such as **110*a*, 110*b* in base plate 100 according to the diameter of the pipe to be supported. For example, the pair of holes 110*a* might be used for a pipe of 2 inch diameter, while the intermediate holes 110 through which the bolts 214 extend as shown in FIG. 1A. might be used for a pipe of 4 inch diameter, and the holes 110*b* might be used for a pipe of 6 inch diameter. The diameter of each of the pins 214 is slightly smaller than the diameter of each hole 110 so that the pins 214 slide in and out of holes 110 and are thus removably mounted on the base 100. Pins 214 are permanently attached to ears 210 and 212 of jaw 200, such as by welding. Ears 210 and 212 are connected by a substantially V-shaped truss 220. V-shaped truss 220 is contoured so as to contact pipe B at areas 222 and 224 separated by approximately 120° on the circumference of pipe B. The contour of truss 220 is such that this approximate 120° separation of the contact points will be maintained regardless of the diameter of pipe being supported in the three positions of the truss 220 referred to above. As seen in FIG. 2, the interior surface of truss 220 has horizontal serrations 221** which can be coated with plastic or other soft material to minimize scratching or damage to the surface of the supported pipe.

Referring again to FIG. 1, gripping jaw 300 is comprised basically of threaded block 310, threaded shaft 320, and gripping head 330. Threaded block 310 is mounted to base plate 100 by means of bolts 316 which extend through block 310 and thread into base plate 100.

Figure 4:
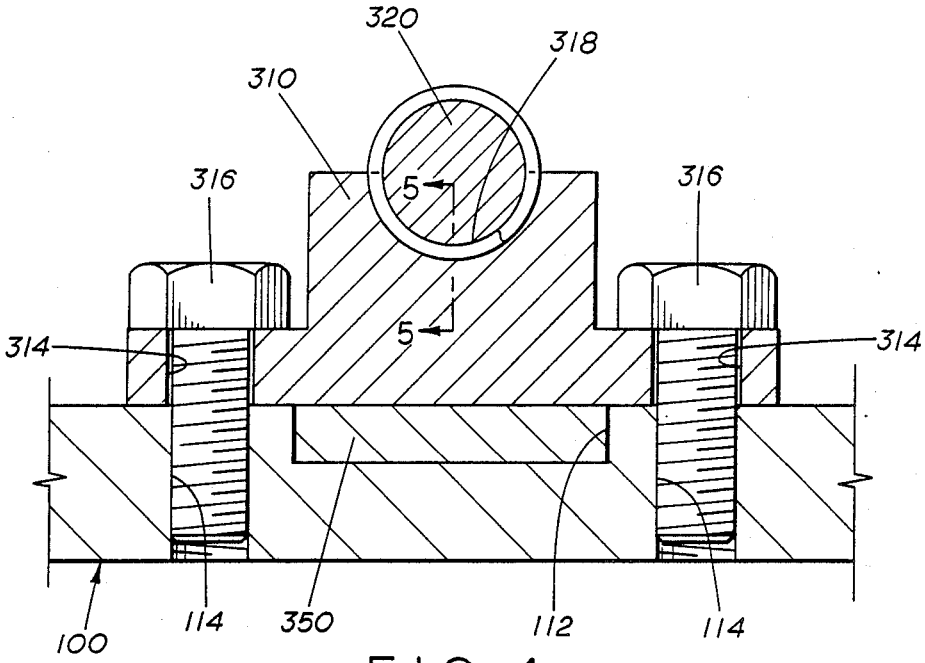
FIG. 4 is a sectional view of the threaded block of the invention, taken on line 4—4 of FIG. 1.

As seen in FIG. 4, threaded block 310 has half threads 318 which can mesh with the threads around one-half the circumference of threaded shaft 320. Bolts 316 extend through smooth bore holes 314 and are threaded into threaded holes 114 in base plate 100. Channel 112 is provided in base plate 100 to aid in maintaining the alignment of gripping head 330 as will be discussed later.

Figure 5:
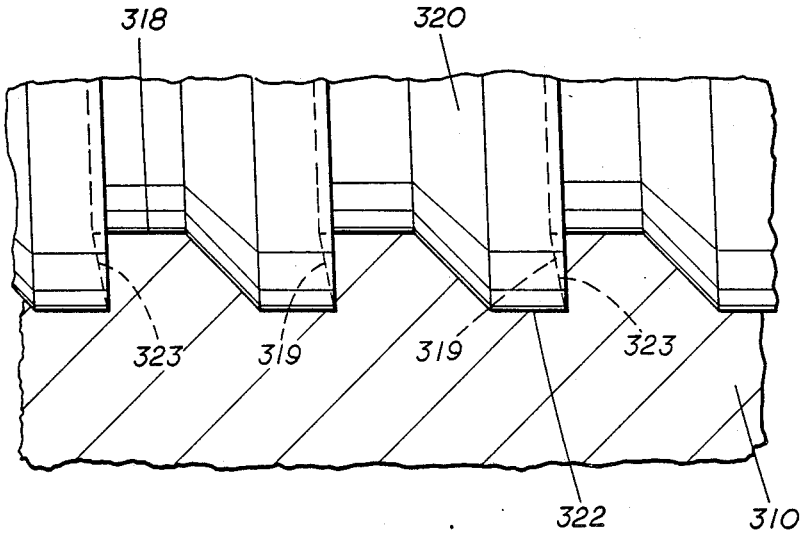
FIG. 5 is a sectional view of the threaded shaft and block of the invention taken on line 5—5 of FIG. 4.

Referring now to FIG. 2, gripping head 330 is pressed against the perimeter of pipe B. Gripping head 330 is urged toward pipe B by threaded shaft 320 which has threads 322 which mesh with threads 318 of threaded block 310. Bar 350 is securely attached to gripping head 330 at one end and it extends from this attachment point substantially perpendicular to the axis of pipe B through channel 112 in base plate 100. Threaded shaft 320 is turned by means of handle 340 which passes through hole 326 in the end of threaded shaft 320 opposite the end which contacts gripping head 330. As shown in FIG. 5, threads 318 and 322 are undercut at surfaces 319 and 323, respectively, to aid in keeping the threads fully meshed.

Figure 3:
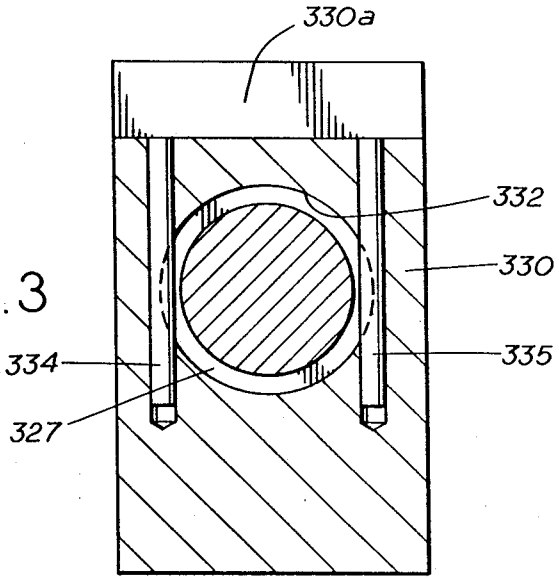
FIG. 3 is a sectional view of the gripping head of the invention taken on line 3—3 of FIG. 1.

Referring now to FIGS. 2 and 3, near the end of threaded shaft 320 which contacts gripping head 330 is annular groove 324. Extending from gripping head 330 into annular groove 324 are retaining pins 334 and 335. The upper surface of gripping head 330 can have a transverse notch on its rear corner to facilitate insertion of pins 334 and 335. The vertical face of this transverse notch is shown as surface **330*a*. The far corner 220*a* of V-shaped truss 220 is seen in FIG. 2 jutting past surface 330*a*. Retaining pins 334 and 335 prevent threaded shaft 320 from disengaging from gripping head 330 but, because they extend into annular groove 324, they do not interfere with rotation of threaded shaft 320 relative to gripping head 330. Annular groove 324 is of sufficient width and is properly placed to allow threaded shaft 320 to completely enter gripping head 330 until end surface 325 of threaded shaft 320 contacts interior surface 333 of gripping head 330. Therefore, when gripping head 330 is tightened against pipe B, force is transmitted directly from the end of threaded shaft 320 to gripping head 330 rather than applying force on pins 334 and 335**.

Referring now to FIG. 2, annular groove 324 is of sufficient width to allow threaded shaft 320 to pivot in the counterclockwise direction as seen in FIG. 2 about pins 334 and 335.

The operation of the device will now be described. Referring to FIG. 2, before the insertion of pipe B, threaded shaft 320 lies engaged with threads 318 in threaded half-nut block 310. After pipe B is inserted in the device, in the interior of stationary gripping jaw or truss 220, the user grasps handle 340 and lifts upwardly on the handle 340 to thus lift the shaft 320 upwardly, which causes the shaft 320 to move upwardly in the counterclockwise direction, as seen in FIG. 2, to the extent permitted by the loose fit of pins 334 and 335 in the annular groove 324. When threaded shaft 320 has pivoted free of threads 318 in threaded block 310 by such upward movement, the user pushes on handle 340 to move the shaft 320 toward pipe B. This pushing force is translated through shaft 320 to gripping head 330 which therefore advances until ridges 338 contact the surface of pipe B. During this movement, alignment bar 350 slides in alignment channel 112, allowing gripping head 330 to translate in an essentially straight line toward pipe B while maintaining the gripping jaw ridges 338 in a substantially vertical position to provide a minimum four-point vertical contact with the pipe by the stationary jaw surfaces at points 222 and 224 and the movable jaw on at least two of the ridges 338. As shown in FIG. 1, at least four ridges 338 are provided, with their apexes designed to contact the surface of a pipe having the largest diameter for which the apparatus is designed, or six inches in the example given above. Then, two of ridges 338 will contact the surface of the smaller sized pipes. The force exerted by ridges 338 on the surface of pipe B urges pipe B into the interior substantially V-shaped contour of truss 220 and into intimate contact with serrations 221 at contact area 222 and 224. Ridges 338, like serrations 221, can be coated with plastic or some other soft material to protect the surface of pipe B. When ridges 338 have forced pipe B into contact with serrations 221, the user lowers handle 340, causing threaded shaft 320 to pivot in a clockwise direction, as seen in FIG. 2, about pins 334 and 335 until threads 322 mesh with threads 318. It may be necessary to rotate threaded shaft 320 slightly in order to cause threads 322 to perfectly mesh with threads 318. This rotation is accomplished by turning handle 340.

After threads 322 have completely meshed with threads 318, handle 340 is then turned farther, causing threaded shaft 320 to thread its way through threaded block 310, applying additional force to gripping head 330 and thereby causing pipe B to be gripped more tightly between ridges 338 and serrations 221. Pipe B will then be supported against vertical movement by the pipe B being gripped under pressure between gripping head 330 and stationary jaw 200.

When it is desired to release pipe B from the device, the user turns handle 340, usually only one or two turns, so as to cause threaded shaft 320 to thread its way back through threaded block 310 away from pipe B a sufficient distance to provide clearance for threaded shaft 320 to be lifted upwardly to pivot it about pins 334 and 335. Handle 340 is then lifted, causing threaded shaft 320 to pivot in the counterclockwise direction as seen in FIG. 2, thus providing a rapid release of the gripping force on the pipe B.

When threaded shaft 320 has pivoted sufficiently to remove threads 322 from threads 318, the user pulls handle 340 and shaft 320 rapidly in the direction away from pipe B. When shoulder 327 of threaded shaft 320 contacts pins 334 and 335, this pulling force is transmitted to gripping head 330, pulling it away from pipe B. During this movement, alignment bar 350 slides in alignment channel 112, again limiting gripping head 330 to linear translation to thereby maintain the vertical position of gripping head 330. When gripping head 330 is completely free of contact with pipe B, the user lowers handle 340, causing threaded shaft 320 to pivot in the clockwise direction, as seen in FIG. 2, until threads 322 again mesh with threads 318. The device is now configured to allow movement or replacement of pipe B.

Referring again to FIG. 1, if it is desired to support pipe of a different diameter within the range of selected sizes of pipe, stationary jaw 200 is lifted until pins 214 are removed from holes 110. Stationary jaw 200 is then relocated in either holes **110*a* or 110*b* according to the diameter of pipe to be supported. Stationary jaw 200 is then lowered onto base plate 100 thereby inserting pins 214 into the selected pair of holes 110*a* or 110*b*. Operation of gripping jaw 300** is the same as described above, regardless of the diameter of pipe being supported in the apparatus.

The preferred embodiment is described here as it is used to support pipe such as tubing in a well bore. This invention can also be used, however, to support such elongate members as drill rods, and its use need not be restricted to use with pipe in a well, as it could also be adapted for the vertical support of other elongate members.

The foregoing description of the device is only illustrative and explanatory thereof. Various other changes in the materials, apparatus, or method of use will occur to those skilled in the art. It is intended that all such variations within the scope and spirit of the appended claims be embraced thereby.

I claim:

1. A device for vertically suspending a tube in a well bore, comprising:

a base plate having a hole therethrough aligned with a well bore to allow the passage of a tube to be suspended in said well bore;

a gripping jaw;

a plurality of sets of jaw attachment means on said base plate spaced to enable selective placement of said jaw to accommodate a plurality of tubing diameters with at least one set of said attachment means on either side of said hole in said base plate;

said jaw having an internal substantially V-shaped gripping surface which is sized to provide two points of contact with said tube and which is releasably attached to said base plate by means of said attachment means on said base plate and is positioned to receive said tube in the interior of said gripping surface;

a gripping head slideably attached to said base plate which contacts said tube on the opposite side from said two points of contact between said gripping jaw and the tube to urge said tube into contact with said gripping jaw;

a threaded shaft pivotably connected at one end to said gripping head to apply force thereto in the direction toward said gripping jaw;

a threaded block on said base plate, having half threads which mesh with threads on said threaded shaft, through which said threaded shaft is screwed to apply force to said gripping head;

said half threads on said threaded block meshing with said threads on said threaded shaft around only about half of its circumference, allowing disengagement of said threads when said threaded shaft pivots about said end which is connected to said gripping head;

an alignment channel in said base plate the longitudinal axis of which is parallel to the central axis of said half threads; and an alignment bar attached at one end to said gripping head, which slides in said alignment channel to restrict said gripping head to linear movement.

2. A device for vertically suspending a tube in a well bore, comprising:

a base plate having a bore hole therethrough aligned with a well bore, to allow the passage therethrough of a tube to be suspended in said well bore;

two rows of alignment holes on said base plate, parallel to a longitudinal axis of said base plate, one of said rows being on each side of said bore hole;

a pipe gripping jaw attached to said base plate by selectively engaging one hole in each of said rows of alignment holes so as to straddle said bore hole, said jaw having an internal substantially V-shaped gripping surface which is adapted to contact said tube at two points; said jaw being movable for selective positioning in the alignment holes to position the internal V-shaped gripping surface so as to contact tubes of various diameters at two points;

a gripping head slidably mounted on said base plate so as to slide along said longitudinal axis of said base plate to provide a three-point contact with said tube by said jaw and gripping head; and, a threaded shaft pivotably mounted at one end to said gripping head so as to releasably engage threads on said base plate for forcing said gripping head against said tube.

* * * * *